US005768857A

United States Patent [19]

Ward et al.

[11] Patent Number: 5,768,857

[45] Date of Patent: Jun. 23, 1998

[54] MULTIPLE PERFORATING, AUTOMATIC FOOD PREPARATION LINE HAVING IN-LINE FOLDOVER FOR FOOD SET-UPS

[75] Inventors: Lawrence A. Ward, 26 Woodstock Cir., Collegeville, Pa. 19426; Dante Pietrinferni, Coatesville; Allen Ely, Downingtown, both of Pa.

[73] Assignee: Lawrence A. Ward, Collegeville, Pa.

[21] Appl. No.: 642,001

[22] Filed: May 2, 1996

[51] Int. Cl.[6] ..... B65B 35/50

[52] U.S. Cl. ..... 53/447; 53/462; 53/531; 53/389.2; 53/389.3; 426/129

[58] Field of Search ..... 53/447, 465, 461, 53/462, 210, 220, 514, 389.2, 389.3, 531; 426/129, 121

[56] References Cited

U.S. PATENT DOCUMENTS

| | | | |
|---|---|---|---|
| 2,996,236 | 8/1961 | Barr | 426/121 |
| 3,145,112 | 8/1964 | Boegershausen | 426/129 |
| 4,003,184 | 1/1977 | Shiu | 53/461 |
| 4,532,751 | 8/1985 | Mally et al. | 53/435 |
| 5,426,917 | 6/1995 | Daane et al. | 53/435 |
| 5,484,613 | 1/1996 | Fisher, Jr. | 426/129 |

*Primary Examiner*—James F. Coan
*Assistant Examiner*—Gene L. Kim
*Attorney, Agent, or Firm*—Panitch Schwarze Jacobs & Nadel, P.C.

[57] ABSTRACT

Automatic in-line food preparation machines. The machines comprise perforating mechanisms which can provide multiple perforations in substrates. Preformed portions of food are then placed on the predetermined lengths of substrate having multiple perforations. An in-line foldover mechanism is also provided which folds paper flaps over food slices for efficient food preparation creation.

12 Claims, 4 Drawing Sheets

MULTIPLE PERFORATING, AUTOMATIC FOOD PREPARATION LINE HAVING IN-LINE FOLDOVER FOR FOOD SET-UPS

FIELD OF THE INVENTION

The present invention relates generally to interleaving stacking devices to make food preparations. More specifically, the present invention relates to methods and systems for in-line foldover of food preparations.

BACKGROUND OF THE INVENTION

Automated food processing machines have become prevalent in the art for creating food "set-ups" for future use, such as sandwich making, and for creating patterns of food for storage and shipping. A set-up is generally known in the art as a layered stack of one or more food items placed on a predetermined length of paper. Set-ups usually comprise sandwich meats, cheeses, hors d'oeuvres servings, and other types of food, such as sliced tomatoes, so that a food preparer can simply unload a set-up in a food preparation process for ease of use. Typically, the set-ups have a particular weight of food servings, and are therefore known to be "prefabricated", thereby eliminating the need to continually slice and weigh food for future preparation.

Since food set-ups have become part of the desired methodology in the art for fast-food preparation, interleaving and stacking machines have been created to automatically prepare food set-ups. One such machine is described in U.S. Pat. No. 5,426,917, Daane et al., which discloses an apparatus for making food set-ups. The machinery of the Daane et al. patent makes food set-ups which can be cut and wrapped in separate finished set-up portions, and then separated and stacked for sanitary loading of the set-ups so that when the set-ups are unpackaged, they are ready for use.

In addition to the preparation of food set-ups, automatic sheet stacking machines for food products are also known in the art for automating food cutting and stacking procedures for food products such as bacon and the like. One such system for automatic food sheet production is described in U.S. Pat. No. 4,532,751, Mally et al. The Mally et al. patent teaches a machine for bacon packaging and the like wherein the bacon is formed on a pre-cut, thin substrate such as a sheet of paper, wherein the bacon falls on the sheet of paper in a predetermined pattern. The sheets of bacon in the pattern are then stacked to form stacks of food products in a pre-selected size.

In the two above-referenced patents and in the art as a whole, it is necessary to cut sheets of paper into predetermined lengths can be separated and stacked. Thus, the Daane et al. patent and the Mally et al. patent teach that the predetermined lengths of paper are cut by some form of substrate cutting assembly which includes a paper roll and roll-off wheel to form predetermined lengths of paper. The predetermined lengths of paper carry the food material for the set-ups or other food preparations and then are folded over to protect the food on the paper, thereby forming a pocket of food which is encased by the paper.

However, the machines described in the above-referenced patents and in the art as a whole have only been able to make one fold in the paper, and have also required that the folding process be done with a complicated mechanism. For example, the Daane et al. patent uses a complicated air system with proximity switches to blow the flap of paper upward in order to fold the paper over. See column 7, lines 13–36 of the Daane et al. patent. This is a complicated "out-of-line" system which requires a conveyor to move in more than one direction in order to provide paper foldover.

Thus, the art has not created a solution for efficient and cost-effective food stacking or set-up preparation machines which are versatile and reliable. There therefore exists a long-felt need in the art for a food slicing, stacking, and/or interleaving machine to provide food stacking and foldover with efficiency. These needs have not heretofore been met by the present methods.

SUMMARY OF THE INVENTION

The aforementioned problems are solved and long-felt needs met by methods of producing sliced food preparations provided in accordance with the present invention. Preferably, the methods comprise unrolling partially a roll of substrate which will be cut into predetermined lengths of substrate on which the preparations will be placed. More preferably, the methods further comprise perforating in at least one orientation the predetermined lengths of substrate, moving the predetermined lengths of substrate in a direction, and placing at least one pattern of sliced food on the predetermined lengths of substrate, wherein the food does not overlap the perforations, thereby creating an area on the predetermined lengths of substrate which is not covered by the food. Still more preferably, the methods comprise folding the area of substrate over the food as the predetermined lengths of substrate are moved further in a direction.

Systems for automatically making food preparations provided in accordance with the present invention also meet the above-referenced needs. In a preferred embodiment, the systems comprise a conveyor for transporting sheets of substrate in predetermined lengths in a direction, and a substrate which unrolls and cuts the substrate into the predetermined lengths and places the predetermined lengths onto the conveyor. Still more preferably, the systems comprise a perforator which perforates the predetermined lengths of substrate in at least one orientation, thereby creating at least one area on the predetermined length which will receive the food to construct the preparations and at least one area which can be folded over the preparations as the preparations are conveyed in a direction on the conveyor. In yet further preferred embodiments, the systems comprise a foldover mechanism interfaced across the conveyor for folding the area which will be folded over the preparations across the preparations as the predetermined lengths of substrate are moved in the direction by the conveyor.

In still further preferred aspects of the invention, the systems for automatically making food preparations comprise multiple perforators to provide multiple perforated substrate lengths and widths so that more than one direction of substrate foldover can be accomplished. Even more preferably, the machines comprise a smoothing element which smooths the substrate on the food preparations after being tamped down by the foldover bar.

In yet further preferred aspects of the present invention, a mechanism for folding a length of substrate over food slices to create a food preparation is provided. The substrate preferably comprises a first angled member having a first end which attaches to a first portion of a conveyor section of a food stacking machine, and a second end which attaches to a second portion of the conveyor section, the first angled section being angled with respect to the plane of the conveyor so that the first end catches the substrate and the substrate is folded over the food as it progresses down a conveyor and travels up towards the second end. Still more preferably, the mechanism comprises a second angled member formed on the first angled member for tamping the substrate over the food as the substrate is conveyed over the conveyor.

Methods and apparatus provided in accordance with the present invention provide for creation of efficient inline food set-ups or other food preparations, thereby eliminating the need for complex foldover devices as those found in prior automated machines. Furthermore, with methods and apparatus described and claimed herein, multiple perforations can be made in the substrate to accommodate complex food patterns and preparations which are becoming popular in the fast-food preparation industry. These needs have not heretofore been addressed or solved by the art.

The invention will be best understood by reading the following detailed description of the invention in conjunction with the drawings which are first described briefly below.

DETAILED DESCRIPTION OF PREFERRED EMBODIMENTS

Figure 1:
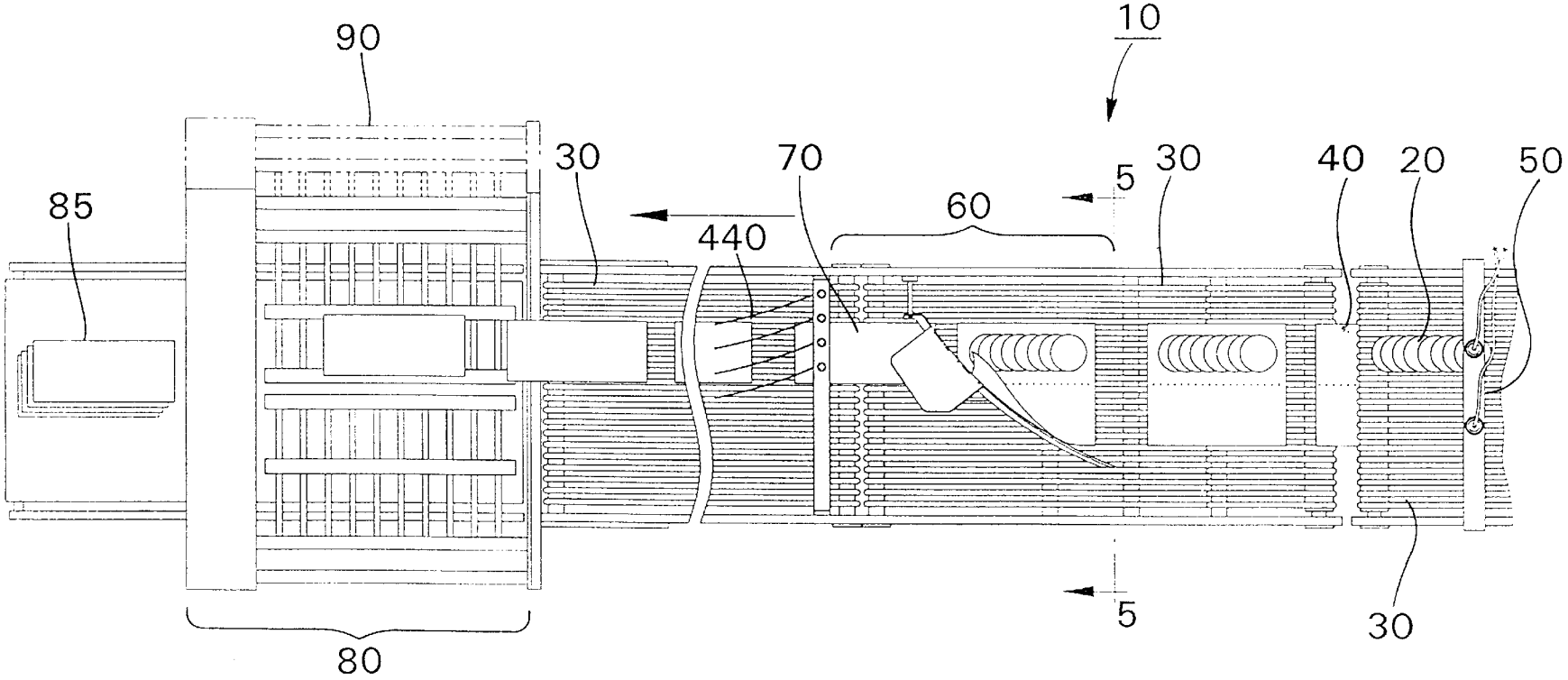
FIG. 1 is a plan view of an automatic food preparation machine having an in-line foldover mechanism provided in accordance with the present invention.

Referring now to the drawings wherein like reference numerals refer to like elements, FIG. 1 is a plan view of an automatic food preparation machine provided in accordance with the present invention shown generally at 10. The machine is adapted to automatically make stacked, interleaved food preparations such as set-ups and other stacked items. As used herein, the term "food preparation" is meant to encompass, without limiting the invention in any way, a classic food set-up or any other type of stacked food product which is typically first sliced and then placed on a piece of predetermined cut length paper or substrate for further use.

In general, the machine 10 is comprised of several sections. At least one slicing section (not shown in the schematic of FIG. 1 but well known to those with skill in the art) slices and places the food 20 in a pattern on a conveyor belt or system 30 which moves in a direction as shown in FIG. 1. The food pattern 20 is placed on a predetermined cut length of substrate which, as will be described in more detail below, emerges from below the conveyor belt 30 and onto the belt where it preferably captures the food 20 as it moves in the direction on the machine 10. The substrate is any U.S. Food & Drug Administration approved substrate, such as paper or polyethylene, on which it is permitted to place food for storage and/or stacking. The terms "substrate and "paper" are used interchangeably herein to denote such an item. The food and paper combination is preferably created when the predetermined cut length of substrate 40 emerges to capture food slices and pattern 20.

In order to determine the length of substrate which is needed to capture the food pattern 20, in a preferred embodiment a set of electric eyes 50 are provided which scans the food pattern 20. Preferably, the electric eyes subassembly 50 provides a signal to a computer controlled cutting mechanism which will cut the substrate in a predetermined length when the electric eyes sense that the pattern 20 is complete and is therefore ready to be placed on the predetermined length of substrate 40. It will be appreciated that other assemblies can be used in place of electric eyes subassembly 50 to provide control signals to the substrate-cutting assembly. Any device which can sense the food items will suffice to perform this function. Generally, but without intending to limit the invention, the substrate lengths will be determined as a function of food pattern 20, conveyor 30 speed, paper perforation (to be described in more detail below) or a combination of some or all of these factors.

The conveyor belt 30 then preferably moves the stacked food items to a folding section shown generally at 60, which folds the substrate over onto the food slices such that a set-up or other prepackaged food preparation unit 70 is created. The unit 70 then traverses further down the conveyor to other portions of the machine 10.

As discussed above, the conveyor 30 generally traverses in one direction, and eventually preferably moves the food unit preparations 70 further onto a stacking section 80 which stacks the individual food preparation units 70 so they can be stacked. The stacker is adjustable, as shown at 90, so that the machine can produce a neat and efficient stack. It is desired to create an adjustable stacker to make machine 10 versatile so that when different types of products are processed, the machine will correctly stack the products along the centerline of the machine. The stack 85 is then usually further loaded into boxes for shipment to a food preparation plant, supermarket or other facility which has a need for stacked food preparations or set-ups.

It is generally known by those with skill in the art that automatic food preparation machines such as those shown at 10 in FIG. 1 are powered by a series of motors, gears, and linkages which operate the various subassemblies and mechanisms in machine 10, and which move the conveyor belt 30 to transport the food set-ups or preparations in an automatic fashion. Such powered automatic arrangements are typically shown in the above-referenced Daane et al. and Mally et al. patents, the teachings of both of which are specifically incorporated herein by reference.

Figure 2:
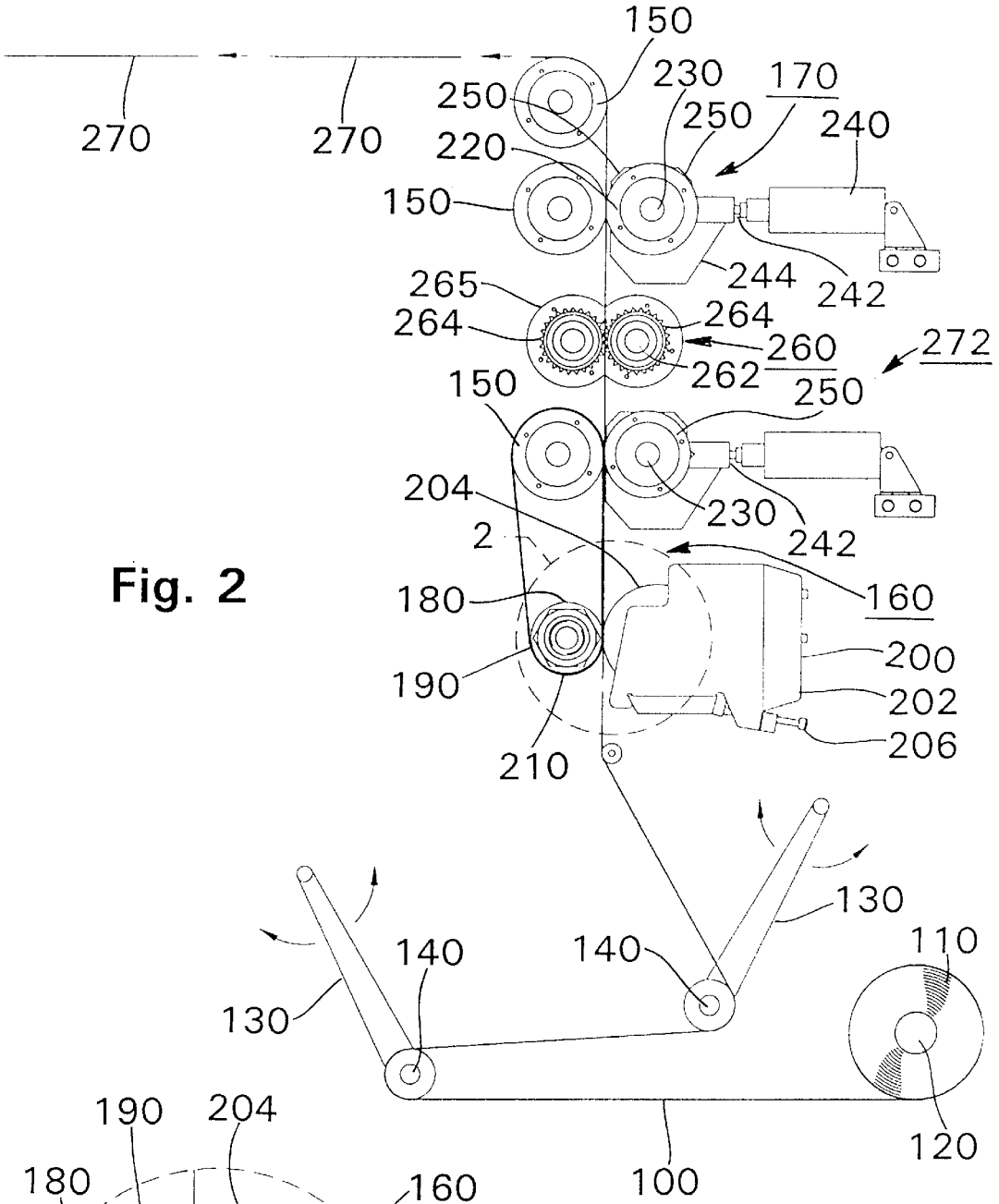
FIG. 2 is a schematic diagram of a perforator and paper cutter section of the machine illustrated in FIG. 1.

FIG. 2 illustrates important and salient features of the present invention relating to the introduction of perforations in the substrate to allow for efficient foldover of the substrate onto the food slices to form food preparations. A thin substrate 100 is unrolled from a roll of substrate 110 which is placed on a spindle 120 as shown in FIG. 2. Tension bars 130 allow the substrate 100 to be adjusted with tension for proper feeding of the substrate supply through the use of a device that sends a signal from the tension bars 130 to the spindle 120. The tension bars 130 rest on a pair of dancers 140 which float after the correct amount of tension is applied to the substrate 100. As the substrate 100 traverses through the substrate perforating /cutting subassembly of FIG. 2, a series of rubber rollers 150 are preferably provided to place pressure on the substrate 100 and move it through the mechanism. The paper is preferably pressed against at least one perforating/cutting mechanism shown generally at 160, and at least one substrate perforating/cutting subassembly shown at 260.

Figure 3:
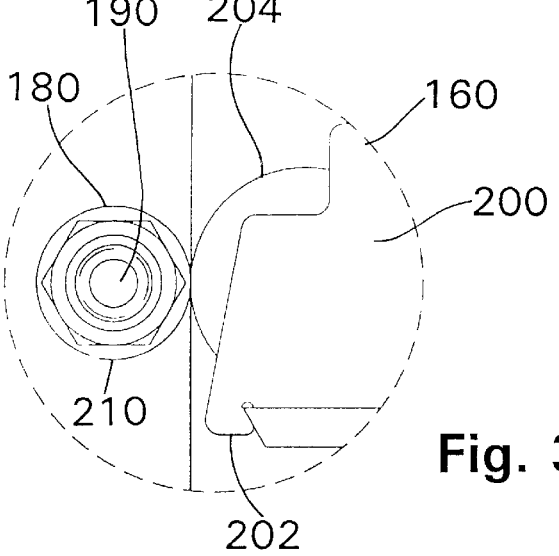
FIG. 3 is a schematic view of a perforator of FIG. 2.

Referring now to FIGS. 2 and 3 collectively, a perforating/cutting mechanism of the present invention is illustrated. In a preferred embodiment, the mechanism comprises a perforating roll 204 which is more preferably a cylinder that rotates on a spindle 190 according to a desired speed. The perforating cylinder 180 rotates according to a timed sequence impressed upon the perforating roll by a computer-controlled mechanism which generally comprises and works with a set of gears and/or chains, belts or pulleys to force the perforating roll 180 to rotate.

The microprocessor which controls this function is not shown in this figure, but it is well understood in the art that such a device is programmed to cause the perforating roll 180 to rotate around spindle 190 so as to provide regular patterns of perforations on the substrate 100.

The device further comprises a perforator/cutter assembly 200 which is preferably air activated and acts to force a perforating/slitting wheel 204 against roller 180 so that the substrate 100 is cut or perforated correctly. The assembly 200 preferably further comprises a housing 202 which contains an air cylinder to activate the wheel 204 against substrate 100. The mechanism 200 is secured by screw or locking mechanism 206 to the machine 10.

In a preferred embodiment when mechanism 200 functions as a perforator rather than a slitter, first perforations are created by perforation knife 204 which pierces the substrate in a first orientation and preferably in a substantially linear fashion so as to create an even perforation through the longitudinal direction of the substrate 100. The first longitudinal cuts, slits or perforations are created at predetermined locations in the substrate. It will be appreciated that it is within the scope of the present invention that several perforating/slitting devices 160 can be placed in the paper perforation and cutting mechanism of FIG. 2. In this manner, more than one longitudinal perforation or slit can be applied to the substrate 100 in multiple orientations if so desired. Furthermore, if perforations are desired, wheel 204 will be a perforating wheel. However, if a slit is desired, wheel 204 will be a slitting knife which creates a continuous slit in the substrate which will allow the substrate to be separated from another section of the substrate.

As mentioned above, it may be desirable in certain food preparation applications to provide more than one perforation orientation or substrate separation direction for the substrate. Therefore, in a further preferred embodiment, a second perforating or cutting mechanism 260 is provided to the machine 10 to provide a perforation or cut in a second orientation on the substrate 100. In a preferred embodiment, second mechanism 260 comprises a geared, cylindrical perforating/slitting knife shaft 262, which may have knife blades formed thereon oriented at opposing 180° angles apart on the shaft 262. Gears 264 are formed in shaft 262 to work with reciprocal gears in a rubber roller 265 which provides a back-up to the knife/perforator in shaft 262.

Alternatively, shaft 262 could be adapted to provide a separation cut in the substrate. However, it will be appreciated by those with skill in the art that when more than one perforation in more than one orientation must be made, second perforating mechanism 260 must be used to create perforations in a second orientation on the substrate rather than as a paper cutting mechanism.

In order to move the substrate through the paper cutting mechanisms or machine 10, a series of rubber rollers 150 are provided which are motor driven. The rubber rollers 150 can be driven by separate motors when it is desired to move the substrate 100 through the mechanism at different speeds at different points in the machine so as to provide forces which will separate the substrate or otherwise control perforation orientations. For instance, upper roller 150 could be computer-driven through a drive motor at one speed, or in a start-stop mode, to separate the substrate from different sections so as to create separate pieces of substrate for the food preparations, while the lower roller 150 can be separately motor-driven in conjunction with a belt or chain 190 and the roller 180 of first perforating/slitting mechanism 160. The second computer-controlled motor drive for lower roller 150 in conjunction with belt 190 will thus allow mechanism 160 to provide perforations or slits in substrate 100 at a desired second speed.

In addition, there are preferably provided at least two air driven mechanisms 240 and 272 which act to push the substrate against rubber rollers 250 and 150. The air-driven mechanisms 240 and 272 preferably comprise rubber rollers 250 which rotate around shafts 230 and which are interfaced through pivot arms 244 to push the substrate against the rubber rollers 150. Air cylinders 240 actuate the pivot arms through shafts 242 to provide pressure to allow rubber rollers 250 to push substrate 100 against motor-driven rubber rollers 150, thereby allowing the paper to efficiently traverse through the machine 10. A pulley 220, which can also be beltor chain-driven allows the cut substrate pieces 270 to traverse through the machine so that the food preparations can be folded and stacked.

It has also been found that it is desirable to provide a separate motor-driven conveyor section to speed up the food preparation units after they have been folded. This allows the food preparation units to have enough momentum to be driven through the folding section and onto the stacking section of the machine 10.

Figure 4:
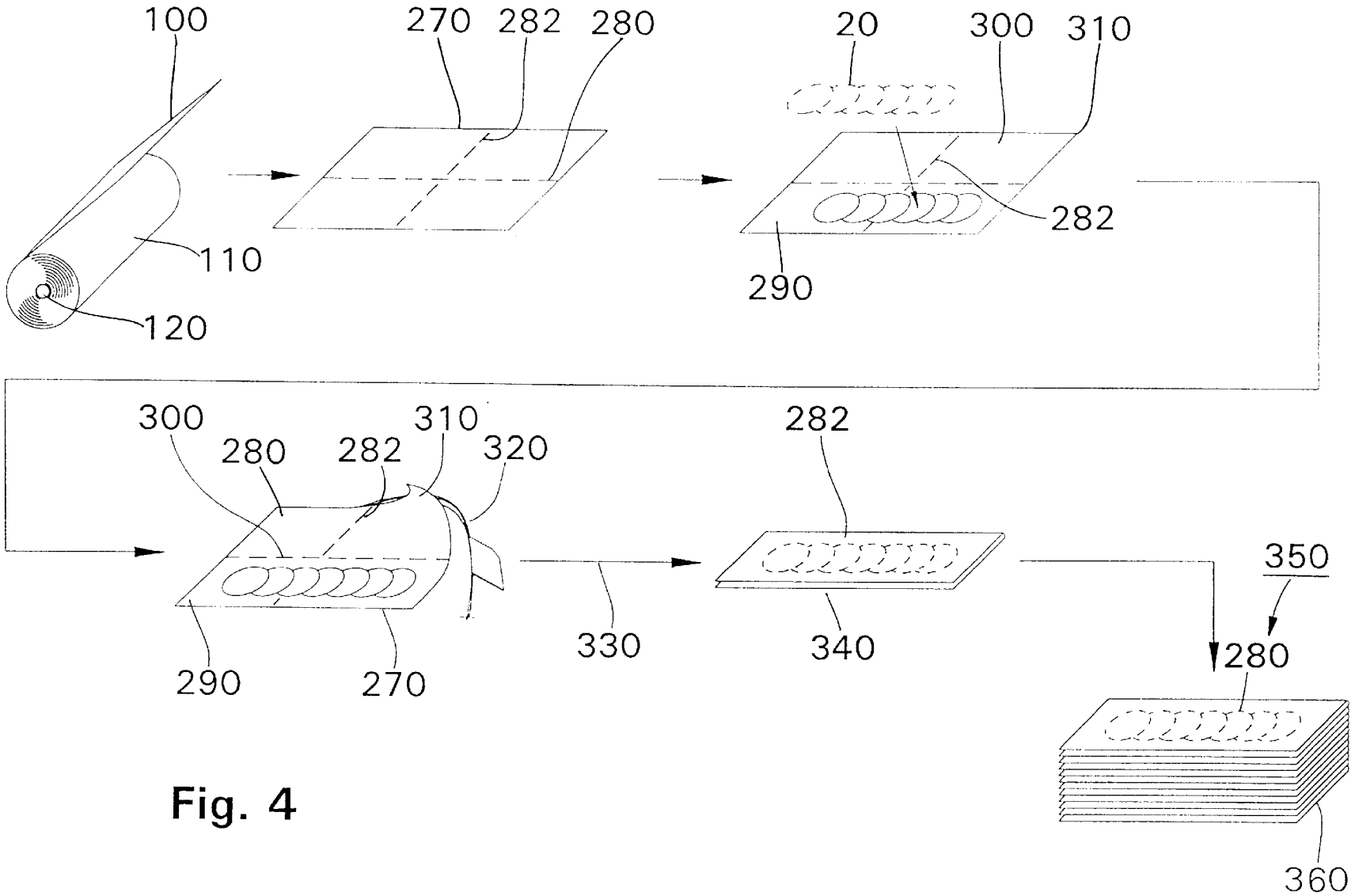
FIG. 4 is a schematic of a process of food preparation creation provided in accordance with the present invention.

Referring to FIG. 4, methods of making food preparations in accordance with the present invention are illustrated. The substrate 100 is off-fed from roll 110 which rotates around spindle 120. The perforated predetermined substrate lengths 270 are then placed on the conveyor 30. In the preferred embodiment of FIG. 4, two perforations have been made by perforating mechanisms in the substrate perforating/cutting sections of the automated food preparation machine provided in accordance with the present invention as shown in FIG. 2, for example.

More preferably, a perforation 280 is provided longitudinally in the direction of the motion of the predetermined substrate length 270, and a perforation 282 is also provided horizontally across the width of the predetermined length 270. It will be recognized by those with skill in the art that any number of perforations could be made in any number of orientations on the predetermined length of substrate 270 according to the particular needs of the food set-up or preparation that is being automatically produced by the machines provided in accordance with the present invention.

As the substrate lengths 270 emerge onto the conveyor 30, the food slices 20 are then preferably placed on a first area 290 of the perforated, predetermined cut length of substrate 270. The food slices to make a set-up or other preparation are placed in any particular pattern as is necessary and may come from multiple slicers interfaced to the machine 10. Depending upon the number of slicers used, the conveyor belt 30 will have an appropriate length to accommodate the different kinds of food slices placed in a pattern on the substrate length 270.

In a preferred embodiment of the invention, by placing the food pattern 20 on the first area 290 of the substrate 270, a second area 300 is created on the opposite side of the first perforation 280 as shown. This creates a fold or flap of substrate 310 which can then be folded over food slices 20 in the pattern. Still more preferably, foldover is provided in an "in-line" fashion by a foldover mechanism shown generally at 320 which mechanically folds the flap 310 over the first area 290 as the substrate length 270 traverses in the direction 330 of the movement of the conveyor in the machine 10. The folded food preparation or set-up 340 is thus created which can be stacked at 350 to create a stack 360 of food preparations that can be further boxed or stored, and can be conveniently individually used as is desired for the particular food preparation process in which the food preparation is needed.

Figure 5:
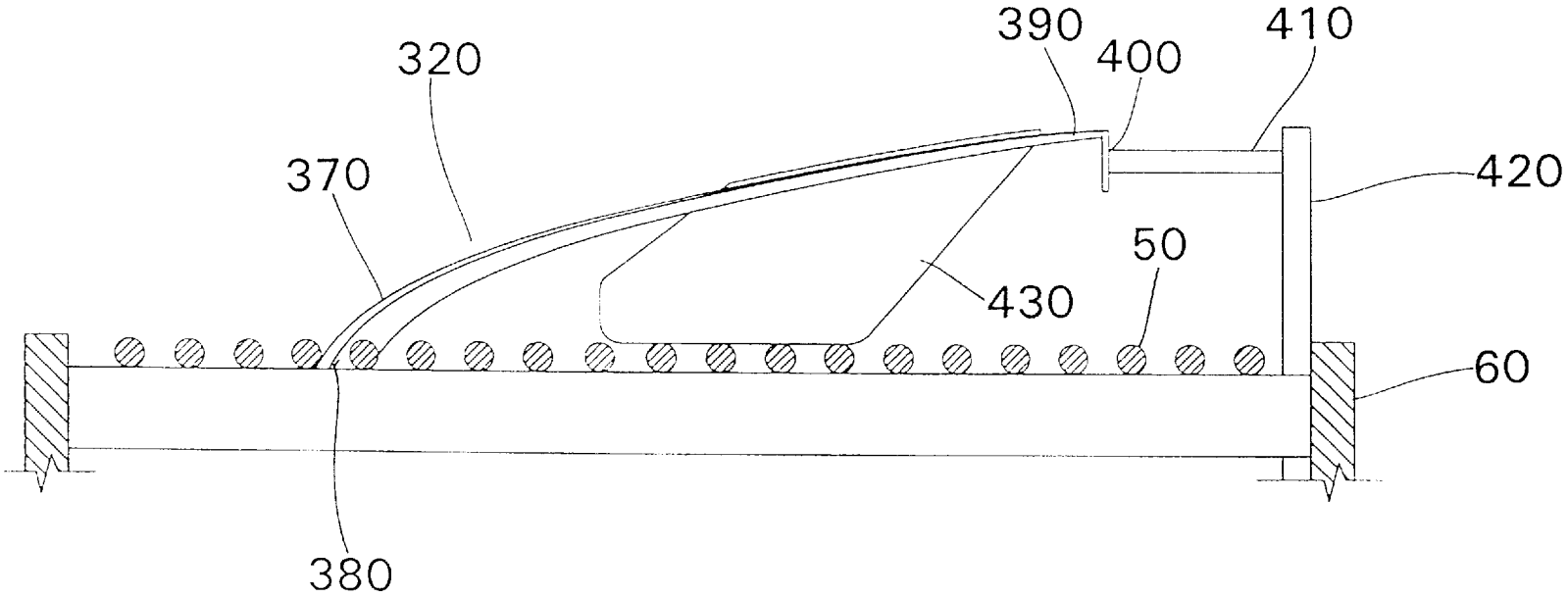
FIG. 5 is a view taken along the 5—5 line of FIG. 1 showing a foldover bar provided in accordance with the present invention.

Referring to FIGS. 1, 4 and 5 collectively, a preferred embodiment of the adjustable foldover mechanism 320 and its operation is illustrated. The foldover mechanism 320 preferably comprises a first angled member 370 having a first end 380 which is secured by a bolt or similar device to a portion of the folding section 60 of the machine 10. The first angled member 370 preferably makes a sweeping angle upwards towards a second end 390 of the foldover mechanism 320 which is secured to a second portion 400 of the foldover section 60 of machine 10. In a preferred embodiment, an adjustable securing extension 410 is provided secured to a post 420 which is bolted to machine 10 to provide a location on which the second end 390 of foldover mechanism 320 can be sturdily attached. The adjustable extension 410 allows the degree of fold to be modified.

Even more preferably, the foldover mechanism 320 comprises a second angled member 430 which is positioned on the first angled member 370 between the first and second ends 380 and 390 respectively. The second angled member 430 makes an angle with respect to the first angled member in a downward direction towards the conveyor 30. The two angled members 370 and 430 fold the flaps 310 over the food slices 20 to create the food preparations 340 as the substrate is moved in the direction 330 on the automatic food preparation machine 10. The second angled member 430 acts to smooth down the foldover portion 310 of the substrate 270 as the food preparation 340 moves in-line with the conveyor towards the stacking section 80.

In still a further preferred embodiment, a second smoothing element 440 is attached to the automatic food preparation machine 10 above the conveyer belt 30. The second smoothing element 440 smooths the foldover portion 310 to ensure that the folded over portion is in-line and securely creased against the food elements 20 after being smoothed down by the second angled member 430. In yet a further preferred embodiment, the secondary smoothing element 440 comprises tongs which angle down towards the conveyor belt such that the tips of the tongs smooth out the foldover portion 310 after being smoothed down by the second angled member 430.

In a preferred operation of the automatic stacking and interleaving machines provided in accordance with the present invention, the predetermined cut lengths of substrate 270 traverse in the direction of the conveyor belt towards the foldover mechanism 320 after food slices 20 are placed on the substrate 270. Because the first angled member 370 sweeps an angle up from the conveyor 30 from the first end of the conveyor to the second end of the conveyor, the foldover portion of the substrate paper 310 which does not contain the food slices catches the foldover mechanism in about the area where the first end 380 of the first angled member is attached to the first portion of the conveyor. As the substrate 270 traverses in the direction of the conveyor 30, the flap 310 is moved along the length of the first angled member 320 such that the perforation 280 causes the flap 310 to fold over the food slices 20.

At about the place where the flap 310 is at right angles to the conveyor, the second angled member 430 commences to smooth down the flap 310 so that it is securely creased on top of the food slices 20 to create the covered food preparation 340. The tongs in secondary smoothing element 440 then smooth down the substrate so that it is neatly folded over the food.

It will be recognized that if another perforation with a different orientation is provided as is shown in FIG. 4, a second foldover mechanism can be provided in the correct orientation on the machine 10 to fold over other substrate flaps in accordance with the methods just described. This foldover process is generally denoted herein as an "in-line" process since it does not require the substrate to be moved or manipulated on the conveyor belt in any fashion, and simply occurs as the substrate 270 moves in the direction 330 of the conveyor. Thus, with the apparatus and methods provided in accordance with the present invention, food set-ups and preparations are efficiently organized, and can be made at consistently high speeds.

The automatic food preparation machines provided in accordance with the present invention thus solve a long-felt need in the art for high volume and accurate production of food preparations or set-ups. These machines do not require complex machinery for the foldover process, and also allow for multiple perforations of the predetermined cut lengths of paper which may be necessary for multiple foldover applications. Such results have not heretofore been achieved in the art.

There have thus been described certain preferred embodiments of automatic food processors having in-line foldover perforations provided in accordance with the present invention. While preferred embodiments have been described and disclosed, it will be recognized by those with skill in the art that modifications are within the true spirit and scope of the invention. The appended claims are intended to cover all such modifications.

What is claimed is:

1. A method of producing sliced food preparations comprising the steps of:

unrolling partially a roll of substrate which will be cut into predetermined lengths of substrate on which the preparations will be placed;

perforating in at least a first orientation the predetermined lengths of substrate;

moving the now perforated, predetermined lengths of substrate in a first direction along a conveyor, parallel to the first orientation of the perforations, and placing at least one pattern of sliced food on the predetermined lengths of substrate, wherein the food does not overlap the perforations, thereby creating an open area on the predetermined lengths of substrate which is not covered by the food;

lifting a leading edge portion of the open area of the substrate from a surface of the conveyor using a foldover mechanism;

directing the leading edge portion of the open area of the substrate with the foldover mechanism to a position which is over 90° from an initial position of the substrate; and folding the open area of the substrate over the food in a transverse direction to the first direction to form a fold along the perforations, as the predetermined lengths of substrate are transported in the first direction.

2. The method recited in claim 1 further comprising the step of creating another row of perforations in a second orientation which is not parallel to the first direction on the predetermined lengths of substrate.

3. The method recited in claim 2 further comprising the step of stacking the food preparations in a stack.

4. The method recited in claim 1 wherein the folding step further comprises the steps of:

smoothing the substrate down to crease the substrate along the perforations.

5. A system for automatically making food preparations comprising:

a conveyor for transporting sheets of substrate in predetermined lengths in a first direction;

a substrate supply which is adapted to unroll and cut the sheets of substrate into the predetermined lengths and to place the predetermined lengths onto the conveyor;

a perforator which is adapted to perforate the predetermined lengths of substrate in at least one orientation parallel to the first direction, thereby creating at least one area on the predetermined length which will receive the food to construct preparations, and at least one open area which can be folded over the preparations as the preparations are conveyed in the first direction on the conveyor; and a foldover mechanism located across the conveyor for folding the open area transversely to the first direction across the preparations as the predetermined lengths of substrate are moved in the first direction by the conveyor along a substrate path, the foldover mechanism including a first angled member which extends upwardly from the conveyor and in the first direction, and curves across the conveyor above the substrate path, the first angled member being adapted to lift a leading edge of the substrate in the open area from the substrate path such that the open area of the substrate is continuously folded over the preparation as the substrate travels along the substrate path, with the perforations forming a weakened crease line about which the open area folds.

6. The system recited in claim 5 further comprising a second perforating mechanism which perforates the predetermined lengths of substrate in a second orientation which is not parallel to the first direction.

7. The system recited in claim 6 further comprising a cutting mechanism interfaced with the conveyor which cuts the substrate into the predetermined lengths.

8. The system recited in claim 6 wherein the foldover mechanism further comprises:

a second angled member connected to the first angled member for smoothing the open area of the substrate over the food preparation as the substrate is conveyed along the conveyor.

9. The system recited in claim 8 wherein the foldover mechanism is adapted to fold over the substrate length as the substrate progresses in-line down the system.

10. The system recited in claim 8 further comprising a smoothing member interfaced to the foldover mechanism for smoothing the substrate in-line after it has been folded and progresses in the direction through the system.

11. The system recited in claim 10 wherein the smoothing member comprises at least a plurality of tongs.

12. The system recited in claim 5 further comprising a stacking section which stacks the food preparations after they have been folded over by the foldover mechanism.

* * * * *